US010086604B2

(12) United States Patent
Gardner et al.

(10) Patent No.: US 10,086,604 B2
(45) Date of Patent: Oct. 2, 2018

(54) PRINTING DEVICE

(71) Applicant: HEWLETT-PACKARD DEVELOPMENT COMPANY, L.P., Houston, TX (US)

(72) Inventors: James Gardner, Corvallis, OR (US); Daryl E Anderson, Corvallis, OR (US); Eric T Martin, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/516,389

(22) PCT Filed: Oct. 27, 2014

(86) PCT No.: PCT/US2014/062438

§ 371 (c)(1),
(2) Date: Apr. 1, 2017

(87) PCT Pub. No.: WO2016/068853

PCT Pub. Date: May 6, 2016

(65) Prior Publication Data

US 2017/0305150 A1 Oct. 26, 2017

(51) Int. Cl.
*B41J 2/045* (2006.01)

(52) U.S. Cl.
CPC ..... *B41J 2/04541* (2013.01); *B41J 2/0458* (2013.01)

(58) Field of Classification Search
None
See application file for complete search history.

(56) References Cited

U.S. PATENT DOCUMENTS

| | | | |
|---|---|---|---|
| 4,434,356 | A | 2/1984 | Craig et al. |
| 5,420,783 | A | 5/1995 | Gross |
| 6,068,360 | A | 5/2000 | Hiwada |
| 6,520,615 | B1 | 2/2003 | Beck et al. |
| 7,255,410 | B2 | 8/2007 | Masuda |
| 7,410,231 | B2 | 8/2008 | Zhao et al. |
| 2003/0132988 | A1 | 7/2003 | Beck et al. |
| 2003/0202024 | A1 | 10/2003 | Corrigan |
| 2004/0125157 | A1 | 7/2004 | Edelen et al. |

(Continued)

FOREIGN PATENT DOCUMENTS

| | | |
|---|---|---|
| CN | 101203385 | 6/2008 |
| JP | 2002-337342 | 11/2002 |

(Continued)

OTHER PUBLICATIONS

IP.com search.*

(Continued)

*Primary Examiner* — Lisa M Solomon
(74) *Attorney, Agent, or Firm* — Fabian Van Cott

(57) ABSTRACT

A method of operating a printing device during a power loss event includes, with a power loss detection device, detecting an power loss to a number of high voltage devices. The method further includes, with a voltage regulator coupled to printhead fire control circuitry, maintaining a power loss protection supply voltage ($V_{DD}$_plp) to the printhead fire control circuitry.

15 Claims, 12 Drawing Sheets

(56) References Cited

U.S. PATENT DOCUMENTS

| | | | | |
|---|---|---|---|---|
| 2005/0135132 | A1* | 6/2005 | Masuda | H02M 1/32<br>363/142 |
| 2010/0226054 | A1 | 9/2010 | Salazar | |
| 2013/0286103 | A1 | 10/2013 | Fricke et al. | |

FOREIGN PATENT DOCUMENTS

| | | |
|---|---|---|
| JP | 2003-054097 | 2/2003 |
| JP | 2003291380 | 10/2003 |
| JP | 2006-326935 | 12/2006 |

OTHER PUBLICATIONS

Quick, R.D. et al. http://www.hpmuseum.org/journals/hp41/41pr.htm—"Evolutionary Printer Provides Significantly Better Performance" Mar. 1980.

* cited by examiner

PRINTING DEVICE

BACKGROUND

Printing devices include circuitry used in ejecting ink from printheads. Application of a current to a printhead of a printing device causes an ink droplet to be ejected by heating a resistive element located within an ink supply in a firing chamber. This resistive heating causes a bubble to form in the ink, and the resultant pressure increase forces an ink droplet from a nozzle fluidly coupled to a firing chamber.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1A:
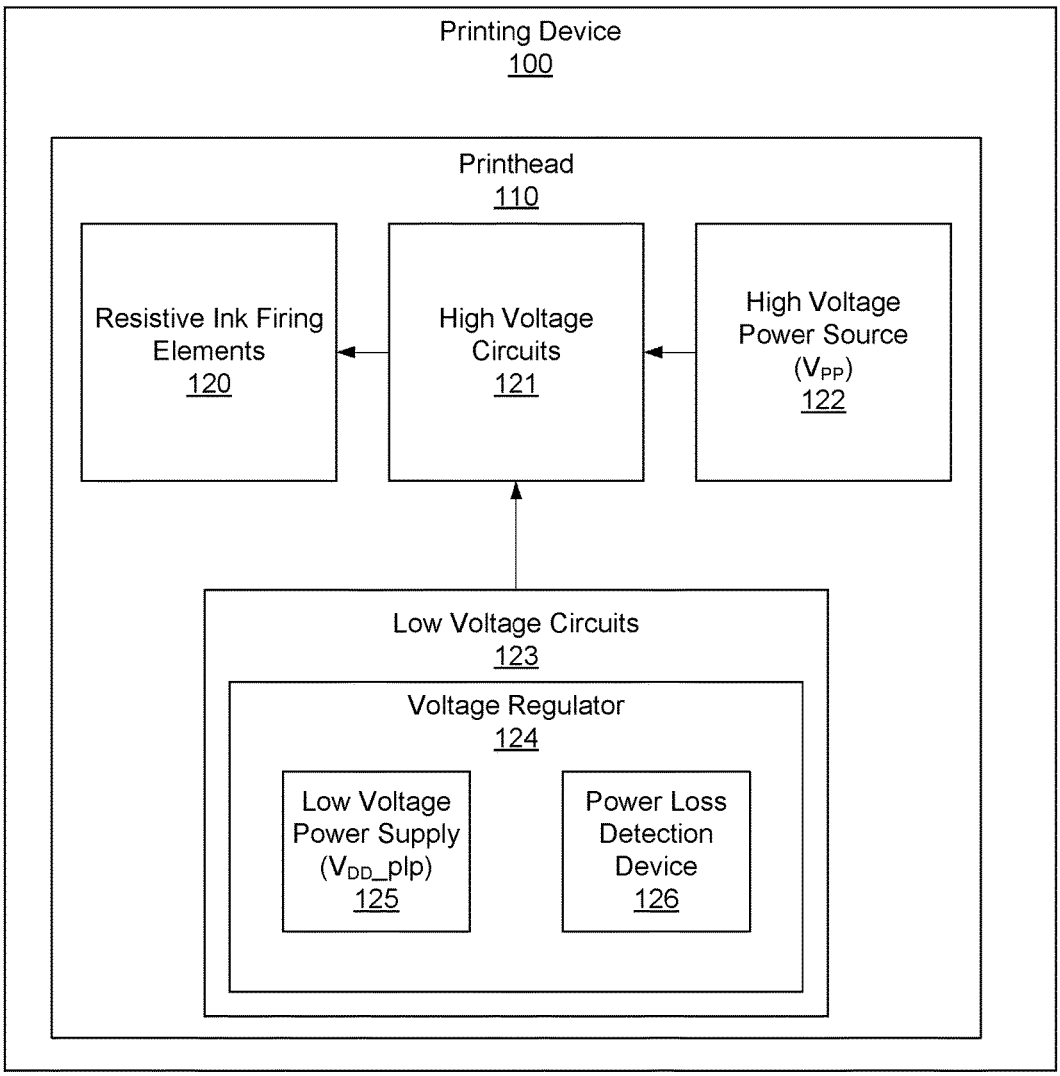
FIG. 1A is a diagram of a printing device incorporating a power loss protection circuit, according to one example of the principles described herein.

The resistive elements located within the ink supply in a firing chamber may be destroyed or otherwise rendered inoperable if too much current is applied to the resistive elements. Therefore, a loss in control of a number of circuits in the printing device through an unexpected or uncontrolled loss in power to the printing device may destroy the resistive elements used to eject ink from the printheads.

Examples described herein provide circuit topologies that reduce or eliminate the potential for uncontrolled high voltage dissipation within printhead resistive elements and other active devices in a number of high voltage circuits of a printing device that may render the resistors and other active devices inoperable. Application of too much energy in a resistor, including resistors used to eject ink from a printhead, may destroy the resistors. Whether the resistor is made of metal-film, wire, glass, glass-ceramic, or another resistive material, its material melts due to the application of too high of voltages. The resulting high temperature destroys the resistor material.

When power to a printing device is lost unexpectedly, the printing device loses control of a number of low voltage circuits that supply fire control signals to a number of high voltage circuits. The high voltage circuits such as nozzle firing field-effect transistors (FETs) that control the firing of ink from the nozzles of the printhead are enabled and disabled based on the signals from the low voltage circuits. Loss of control signals from the low voltage circuits to the high voltage circuits results in loss of control of the high voltage circuits which may result in damage to or destruction of the resistors and other active devices within the printhead. This may be compounded in printing systems that drive page wide arrays or other fixed, commercial-sized printing devices because the amount of energy stored within the circuitry of these larger printing devices is much greater by several factors.

The circuit topologies of the present application utilize the generation of a supplemental or dedicated supply voltage ($V_{DD}$) supply from the supply voltage powering the firing resistors ($V_{PP}$) or the supply voltage for switching a number of field effect transistors (FETs) that connect the $V_{PP}$ to the firing resistors ($V_{PP}$_logic supply). In one example, the $V_{DD}$ voltage generation or a $V_{DD}$_plp voltage generation is moved to an on die location. $V_{DD}$_plp represents a $V_{DD}$ "power loss protected" supply voltage generated by the circuit topologies of the present application, and is provided to circuits within the printing device and the printhead die to prevent $V_{PP}$ from being switched onto the firing resistors in an uncontrolled state.

As used in the present specification and in the appended claims, the terms "power loss," "uncontrolled power loss," or similar language is meant to be understood broadly as any loss of power to any number of circuitry within a printing device.

Further, as used in the present specification and in the appended claims, the term "a number" of or similar language is meant to be understood broadly as any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

Turning now to the figures, FIG. 1A is a diagram of a printing device (100) incorporating a power loss protection circuit, according to one example of the principles described herein. The printing device (100) may include a number of printheads (110). Each printhead includes a number of resistive ink firing elements (120) and a number of high voltage circuits (121) to drive the resistive ink firing elements (120). A high voltage power source ($V_{PP}$) is electrically coupled to the printheads (110) to power the high voltage circuits (121) of the printheads.

A number of low voltage circuits (123) are coupled to the high voltage circuits (121) to provide a number of fire control signals to the high voltage circuits. A low voltage power supply ($V_{DD}$_plp) (125) produced by a voltage regulator (124) is provide to regulate an input voltage. $V_{DD}$_plp is connected to the low voltage circuits (123) to provide power to the low voltage circuits (123). A power loss detection device (126) is provided to detect a power loss to the printing device (100). These various elements will now be described in more detail in connection with FIGS. 1B through 11.

Figure 1B:
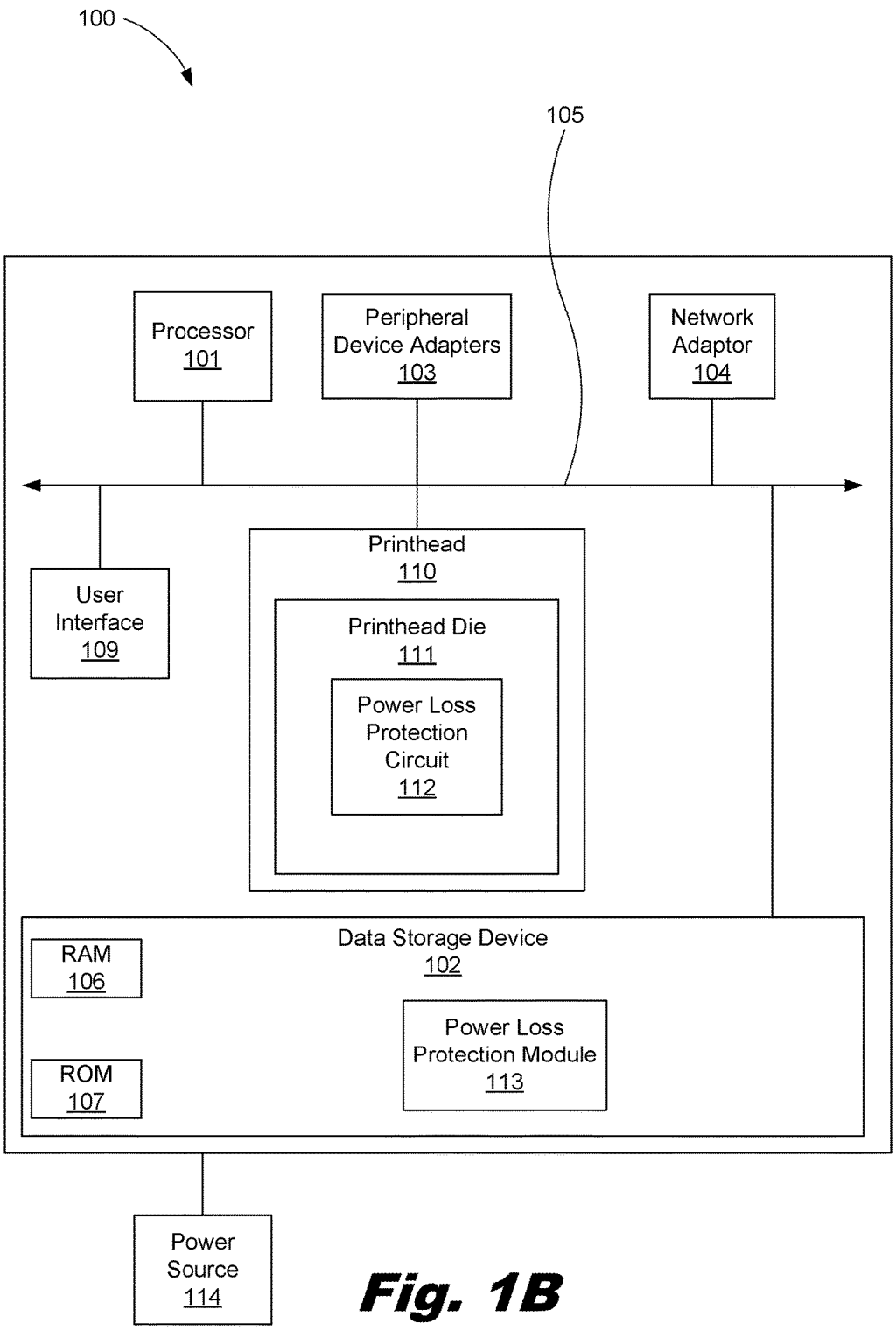
FIG. 1B is a diagram of a printing device incorporating a power loss protection circuit, according to another example of the principles described herein.

FIG. 1B is a diagram of a printing device (100) incorporating a power loss protection circuit (112), according to one example of the principles described herein. The printing device (100) may be implemented in an electronic device. The printing device (100) may be utilized in any data processing scenario including, stand-alone hardware, mobile applications, through a computing network, or combinations thereof. Further, the printing device (100) may be used in a computing network, a public cloud network, a private cloud network, a hybrid cloud network, other forms of networks, or combinations thereof.

In one example, the methods provided by the printing device (100) are provided as a service over a network by, for example, a third party. In this example, the service may include, for example, the following: a Software as a Service (SaaS) hosting a number of applications; a Platform as a Service (PaaS) hosting a computing platform including, for example, operating systems, hardware, and storage, among others; an Infrastructure as a Service (IaaS) hosting equipment such as, for example, servers, storage components, network, and components, among others; application program interface (API) as a service (APIaaS), other forms of network services, or combinations thereof. The present systems may be implemented on one or multiple hardware platforms, in which the modules in the system can be executed on one or across multiple platforms. Such modules can run on various forms of cloud technologies and hybrid cloud technologies or offered as a SaaS (Software as a service) that can be implemented on or off the cloud. In another example, the methods provided by the printing device (100) are executed by a local administrator.

To achieve its desired functionality, the printing device (100) includes various hardware components. Among these hardware components may be a number of processors (101), a number of data storage devices (102), a number of peripheral device adapters (103), and a number of network adapters (104). These hardware components may be interconnected through the use of a number of busses and/or network connections. In one example, the processor (101), data storage device (102), peripheral device adapters (103), and a network adapter (104) may be communicatively coupled via a bus (105).

The processor (101) may include the hardware architecture to retrieve executable code from the data storage device (102) and execute the executable code. The executable code may, when executed by the processor (101), cause the processor (101) to implement at least the functionality of detecting an uncontrolled power loss to a number of high voltage devices, and with a voltage regulator coupled to printhead fire control circuitry, maintaining a power loss protection supply voltage ($V_{DD}$_plp) to the printhead fire control circuitry until a high voltage supply ($V_{PP}$) to the high voltage devices drops below a threshold voltage, according to the methods of the present specification described herein. In the course of executing code, the processor (101) may receive input from and provide output to a number of the remaining hardware units.

The data storage device (102) may store data such as executable program code that is executed by the processor (101) or other processing device. As will be discussed, the data storage device (102) may specifically store computer code representing a number of applications that the processor (101) executes to implement at least the functionality described herein.

The data storage device (102) may include various types of memory modules, including volatile and nonvolatile memory. For example, the data storage device (102) of the present example includes Random Access Memory (RAM) (106) and Read Only Memory (ROM) (107). Many other types of memory may also be utilized, and the present specification contemplates the use of many varying type(s) of memory in the data storage device (102) as may suit a particular application of the principles described herein. In certain examples, different types of memory in the data storage device (102) may be used for different data storage needs. For example, in certain examples the processor (101) may boot from Read Only Memory (ROM) (107), and execute program code stored in Random Access Memory (RAM) (106).

The data storage device (102) may include a computer readable medium, a computer readable storage medium, or a non-transitory computer readable medium, among others. For example, the data storage device (102) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The hardware adapters (103, 104) in the printing device (100) enable the processor (101) to interface with various other hardware elements, external and internal to the printing device (100). For example, the peripheral device adapters (103) may provide an interface to input/output devices, such as, for example, user interface (109), a mouse, or a keyboard. The peripheral device adapters (103) may also provide access to other external devices such as an external storage device, a number of network devices such as, for example, servers, switches, and routers, client devices, other types of computing devices, and combinations thereof.

The user interface (109) may be provided to allow a user of the printing device (100) to interact with and implement the functionality of the printing device (100). The peripheral device adapters (103) may also create an interface between the processor (101) and the user interface (109), another printing device, or other media output devices. The network adapter (104) may provide an interface to other computing devices within, for example, a network, thereby enabling the transmission of data between the printing device (100) and other devices located within the network.

The printing device (100) may, when executed by the processor (101), display the number of graphical user interfaces (GUIs) on the user interface (109) associated with the executable program code representing the number of applications stored on the data storage device (102). The GUIs may display, for example, a number of user-interactive printing options.

The printing device (100) further includes a number of printheads (110) used to eject ink onto a print medium. The printheads (110) operate based on instructions contained within a print job sent from a computing device. The print job contains instructions to print, for example, a document. The processor (101) interprets the print job, and causes the printheads (110) to eject ink onto the print medium such that the document contained in the print job is represented on the print medium.

Each of the number of printheads (110) includes a printhead die (111). A printhead die (111) may be made from a block of semiconducting material on which the functional circuits described herein are fabricated. In one example, the printhead die (111) is fabricated on a wafer of electronic-grade silicon (EGS) or other semiconductor through processes such as photolithography.

The printing device (100) further includes a power loss protection circuit (112) fabricated into the printhead die (111) of each of the printheads (110). The power loss protection circuit (112) may assist the printing device (100) in controlling a number of circuits in a printhead die (111) through an unexpected or uncontrolled loss in power to the printing device. As described herein, an unexpected or uncontrolled loss in power to the printing device (100) may destroy the resistive elements used to eject ink from the printheads (110) or other elements included within the printhead dice (111) of the printheads (110).

The power loss protection circuit (112), in one example, may include a $V_{DD}$_plp voltage regulation block (FIGS. 2 through 6, 212). In one example, the $V_{DD}$_plp voltage regulation block (FIGS. 2 through 6, 212) may continuously provide $V_{DD}$_plp to a number of low voltage circuits that control the firing of a number of high voltage circuits before, during, and after a power loss event occurs. In this example, the $V_{DD}$_plp voltage regulation block (FIGS. 2 through 6, 212) may continually provide $V_{DD}$_plp to the low voltage circuits. When an uncontrolled power loss event occurs, the $V_{DD}$_plp voltage regulation block (FIGS. 2 through 6, 212) maintains $V_{DD}$_plp to the low voltage circuits until a high voltage power supply ($V_{PP}$) applied to the high voltage circuits or its associated logic line ($V_{PP}$_logic) drops below a threshold.

In another example, the $V_{DD}$_plp voltage regulation block (FIGS. 2 through 6, 212) may provide $V_{DD}$_plp to the low voltage circuits when an uncontrolled power loss event occurs, but remaining inactive until the uncontrolled power loss event occurs. In this example, a $V_{DD}$ supply voltage generated off or on the printhead die (111) may be used to power the digital, low voltage control logic until an uncontrolled power loss event occurs. Once a power loss event occurs, the $V_{DD}$_plp voltage regulation block (FIGS. 2 through 6, 212) maintains $V_{DD}$_plp to the low voltage circuits until $V_{PP}$ (209) and $V_{PP}$_logic (210) drops below the threshold.

In the above examples, the $V_{DD}$_plp voltage regulation block (FIGS. 2 through 6, 212) obtains and derives the power for $V_{DD}$_plp from the $V_{PP}$ or an associated logic line ($V_{PP}$_logic). In this manner, the high voltage circuits are protected from damage by ensuring that the low voltage circuits are powered and control of the high voltage circuits is maintained for at least as long as the high voltage circuits are powered. In another example, the $V_{DD}$_plp voltage regulation block (FIGS. 2 through 6, 212) maintains $V_{DD}$_plp at the same voltage level as $V_{DD}$. The high voltage circuits include resistive devices located within an ink supply in a firing chamber of the printheads (110) that cause ink to be ejected from a number of nozzles fluidly coupled to a firing chamber.

Without the functionality of the present systems and methods, a number of power supplies powering the printheads (110), if not powered down in a correct sequence, may damage a number of circuits within the printheads (110) and their respective printhead dice (111). For example, if the $V_{DD}$ supply voltage used to power the digital, low voltage control logic is lost, but $V_{PP}$ and $V_{PP}$_logic supply voltages used to fire nozzle circuits are still powered, then the printhead (110) may enter an uncontrolled firing mode. In this scenario, the resistive devices would likely burn out and become unusable, rendering the printheads (110) defective, and leaving defects in any subsequent prints. Other circuit failures may also render the printhead (110) unusable. The functionality of the power loss protection circuit (112) will be described in more detail below.

The printing device (100) further includes a number of modules used in the implementation of the systems and methods described herein and in printing documents. The various modules within the printing device (100) include executable program code that may be executed separately. In this example, the various modules may be stored as separate computer program products. In another example, the various modules within the printing device (100) may be combined within a number of computer program products; each computer program product including a number of the modules. The printing device (100) may include a power loss protection module (113) to, when executed by the processor (101), generate and maintain $V_{DD}$_plp flow to the low voltage circuits when an uncontrolled power loss event occurs as described herein.

The printing device (100) further includes a power source (114) to power the printing device (100) and its various hardware components including the power loss protection circuit (112). As will be described in more detail below, the power source (114) may be divided into a number of types of power sources that are used by the power loss protection circuit (112).

Figure 2:
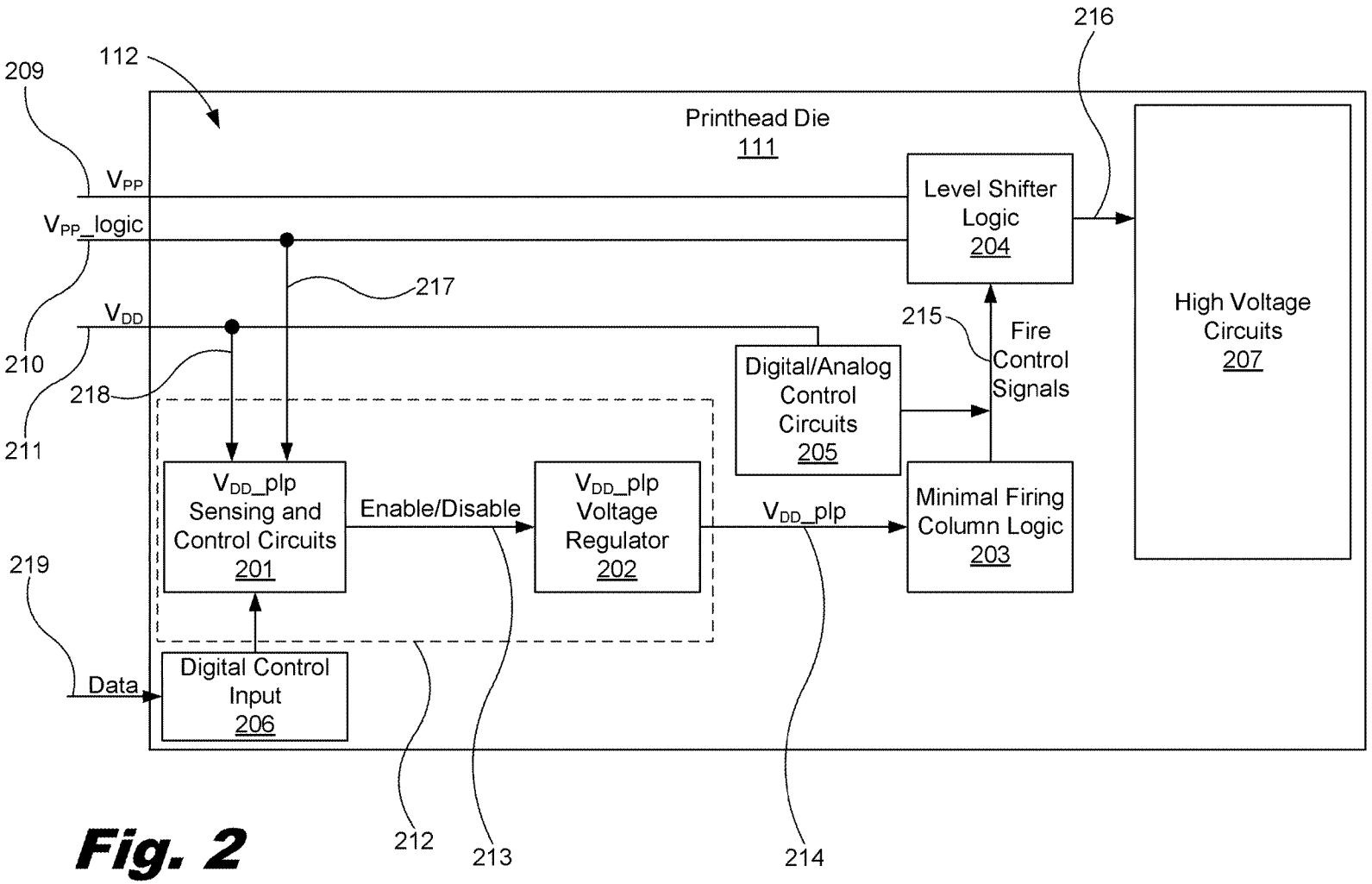
FIG. 2 is a diagram of the power loss protection circuit of the printing device of FIGS. 1A and 1B including an on-die $V_{DD}$_plp voltage regulator block to power a minimal number of firing circuits during a power loss event, according to one example of the principles described herein.

FIG. 2 is a diagram of the power loss protection circuit (112) of the printing device (100) of FIG. 1 including an on-die $V_{DD}$_plp voltage regulator block (212) to power an minimal number of fire control circuits during a power loss event, according to one example of the principles described herein. Several examples of circuit designs of the power loss protection circuit (112) are described in connection with FIGS. 2 through 6. The example of FIG. 2 seeks to maintain power to an exclusive number of circuits that are required to maintain control of the firing of the resistors within the printheads (110) until $V_{PP}$ to bleed down below a safe, threshold voltage level.

The power loss protection circuit (112) of FIG. 2 may include a number of sub-circuits. The sub-circuits may include an on-die $V_{DD}$_plp voltage regulator block (212) including a $V_{DD}$_plp sensing and control circuit (201) and a $V_{DD}$_plp voltage regulator (202). The sub-circuits of the power loss protection circuit (112) may further include minimal firing column logic (203), level shifter logic (204), a number of digital and analog control circuits (205), digital control input (206), other sub-circuits, and combinations thereof. These sub-circuits are coupled directly or indirectly to a number of high voltage circuits (207). As will be described in connection with the circuit designs of FIGS. 2 through 6, the power loss protection circuit (112) may include combinations of these sub-circuits.

The printing device (FIGS. 1A and 1B, 100) may receive electrical power from a main power source and provide the electrical power to the power loss protection circuit (112). As depicted in FIG. 2, a high voltage power supply ($V_{PP}$) (209), a high voltage logic power supply ($V_{PP}$_logic) (210), and a low power voltage supply ($V_{DD}$) (211) may be provided to the power loss protection circuit (112). $V_{PP}$ (209) is used to power a number of high voltage circuits (207) including the firing resistors located within a firing chamber of the printheads (110), power supply pads, signal pads, signal receivers, and other circuits within a printhead die (111) that use a high voltage power supply. In one example, $V_{PP}$ (209) may provide approximately 30V, positive or negative.

$V_{PP}$_logic (210) is a second high voltage supply used to switch a number of field-effect transistors (FETs) that connect $V_{PP}$ (209) to the firing resistors. In one example, $V_{PP}$_logic (210) may provide approximately the voltage provided by $V_{PP}$ (209) minus 2V. In another example, $V_{PP}$_logic (210) may provide approximately 28V, positive or negative. Thus, in one example, $V_{PP}$_logic (210) may be set to a slightly different voltage than $V_{PP}$ (209). This allows the power loss protection circuit (112) to account for system parasitics and provides energy regulation to the nozzles so that the same amount of energy is dispersed in a thermal ink jet firing event.

$V_{DD}$ (211) is used to power a number of low voltage circuits such as the digital and analog control circuits (205). $V_{DD}$ (211) is used to power the $V_{DD}$_plp sensing and control circuit (201) and the $V_{DD}$_plp voltage regulator (202) within the on-die $V_{DD}$_plp voltage regulator block (212) in instances where these elements are used to maintain $V_{DD}$_plp to a number of the low voltage circuits until $V_{PP}$ drops below a threshold. $V_{DD}$ (211) is used to power the low voltage circuits control logic and analog functions used to transmit nozzle fire control signals to the high voltage circuits (207) that control the function of the high voltage circuits (207). In one example, $V_{DD}$ (211) may provide approximately 5V, positive or negative.

The low voltage circuits (201, 202, 204, 205, and 206) may receive the data signals (219) from the printing device (FIGS. 1A and 1B 100), and convert the data signals (219) into nozzle fire control instructions that control the firing of the nozzles within the high voltage circuits (207) as described herein. The low voltage circuits (201, 202, 203, 205, and 206) may further receive $V_{DD}$ (211) to use as a power source for operation of the low voltage circuits (201, 202, 203, 205, and 206).

Thus, a printhead, controlled by the power loss protection circuit (112), has multiple supplies powering it and its various hardware components. However, if $V_{PP}$ (209) and $V_{DD}$ (211) are not powered down in a correct sequence, elements within the high voltage circuits (207) may be damaged. For example, if $V_{DD}$ (211) is lost, but $V_{PP}$ (209) and $V_{PP}$_logic (210) are still powered, then the printhead may enter an uncontrolled firing mode. In this situation, the firing resistors may burn out and become unusable, leaving a defect in any subsequent prints. Other circuit failures may render the printhead unusable.

The power loss protection circuit (112) of FIG. 2 may include the digital and analog control circuits (205). During normal operation, the digital and analog control circuits (205), driven by $V_{DD}$ (211), contain logic and circuitry to provide fire control signals to the level shifter logic (204) and the high voltage circuits (207) as indicated by line 215. The fire control signals (215) control various functions of the level shifter logic (204) and the high voltage circuits (207) such that the level shifter logic (204) and the high voltage circuits (207) are able to bring about the ejection of ink from the printhead (110) in a safe, controlled manner. The fire control signals (215) also control various functions of the level shifter logic (204) and the high voltage circuits (207) to cause the high voltage circuits (207) including its ink firing resistors to print documents in a manner defined by a print job sent from the processor (FIG. 1A, 101) to the power loss protection circuit (112).

The power loss protection circuit (112) of FIG. 2 may further include the level shifter logic (204). The example of FIG. 2 may be classified as a high-side switch design. A high-side switch circuit design is a circuit design that is controlled by an external enable signal such as $V_{PP}$ (209) and $V_{PP}$_logic (210), and connects or disconnects the power source to a given load such as the high voltage circuits (207). In contrast, a low-side switch design is a circuit design that connects or disconnects the load to ground, and therefore sinks current from the load.

Continuing with the description of the level shifter logic (204) of FIG. 2, the level shifter logic (204) serves as switching mechanism by which the fire control signals (215) selectively apply a gate voltage to the gate of a number of transistors when a number of actuators sharing the transistors and their associated nozzles are to be fired. In response to receiving a low voltage digital signal from the digital and analog control circuits (205) or minimal firing column logic (203), the level shifter logic (204) supplies the gates of the transistors with $V_{PP}$_logic (210). Thus, the level shifter logic (204) drives a number of nozzles within the printhead through high voltage signals sent to the high voltage circuits (207) via line 216. The print job sent from the processor is converted by the digital and analog control circuits (205) into fire control signals (215) that command ink to be dispensed from the nozzles.

The high voltage circuits (207) receive the fire control signals (215) from the digital and analog control circuits (205) and $V_{PP}$ (209) and $V_{PP}$_logic (210) from the level shifter logic (204) via line 216, and uses these signals and voltages to heat a number of resistive elements used to eject ink from the nozzles.

Having described how the power loss protection circuit (112) of FIG. 2 operates outside of a power loss event, the power loss protection circuit (112) of FIG. 2 may further include on-die $V_{DD}$_plp voltage regulator block (212)

including a $V_{DD}$_plp sensing and control circuit (201) and a $V_{DD}$_plp voltage regulator (202), and the minimal firing column logic (203) for use in instances where a power loss event occurs. The $V_{DD}$_plp sensing and control circuit (201) of the on-die $V_{DD}$_plp voltage regulator block (212) is used to sense a low $V_{DD}$ (211) voltage and a high $V_{PP}$ (209) or $V_{PP}$_logic (210). More specifically, the $V_{DD}$_plp sensing and control circuit (201) determines if $V_{DD}$ (211) has dropped below a first threshold voltage, if $V_{PP}$ (209) or $V_{PP}$_logic (210) remain above a second threshold voltage, and combinations thereof. In this way, the $V_{DD}$_plp sensing and control circuit (201) is able to determine if a power loss event is occurring within the printing device (FIGS. 1A and 1B, 100).

The $V_{DD}$_plp sensing and control circuit (201) is able to determine if a power loss event is occurring within the printing device (FIGS. 1A and 1B, 100) because the $V_{DD}$_plp sensing and control circuit (201) is electrically connected to $V_{DD}$ (211) and $V_{PP}$ (209) or $V_{PP}$_logic (210) via lines 218 and 217, respectively. The $V_{DD}$_plp sensing and control circuit (201) compares $V_{DD}$ (211) and $V_{PP}$ (209) or $V_{PP}$_logic (210) to each other and the first and second threshold described above. In FIG. 2, the $V_{DD}$_plp sensing and control circuit (201) is depicted as being coupled to $V_{PP}$_logic (210) and not $V_{PP}$ (209). However, the $V_{DD}$_plp sensing and control circuit (201 may be coupled to $V_{PP}$_logic (210), $V_{PP}$ (209), or both to achieve its desired functionality.

More specifically, if the $V_{DD}$_plp sensing and control circuit (201) determines a power loss event is not occurring, then the power loss protection circuit (112) functions as described above, with the digital and analog control circuits (205) and level shifter logic (204) controlling the high voltage circuits (207). If, however, the $V_{DD}$_plp sensing and control circuit (201) determines a power loss event is occurring, then the $V_{DD}$_plp sensing and control circuit (201) send an enabling instructions, via line 213, to the $V_{DD}$_plp voltage regulator (202). In this manner, the $V_{DD}$_plp sensing and control circuit (201) is capable of enabling or disabling the $V_{DD}$_plp voltage regulator (202).

The power loss protection circuit (112) of FIG. 2 may further include the $V_{DD}$_plp voltage regulator (202). The $V_{DD}$_plp voltage regulator (202), when enabled by the $V_{DD}$_plp sensing and control circuit (201) generates and maintains $V_{DD}$_plp (214, 314, 414, 514). In the example of FIG. 2, the $V_{DD}$_plp voltage regulator (202) is enabled in when the $V_{DD}$_plp sensing and control circuit (201) detects a power loss event occurring within the printing device (FIGS. 1A and 1B, 100) as described herein. $V_{DD}$_plp (214, 314, 414, 514) is generated from $V_{PP}$ (209), $V_{PP}$_logic (210) or both. Thus, power from $V_{PP}$ (209), $V_{PP}$_logic (210) or both is pulled from their respective lines via the $V_{DD}$_plp sensing and control circuit (201) and line 217. Thus, although FIG. 2 depicts the $V_{DD}$_plp sensing and control circuit (201) connected to $V_{PP}$_logic (210), in other examples, the $V_{DD}$_plp sensing and control circuit (201) may be connected to $V_{PP}$ (209), $V_{PP}$_logic (210) or both.

In the example of FIG. 2, the $V_{DD}$_plp voltage regulator (202) provides $V_{DD}$_plp (214, 314, 414, 514) to minimal firing column logic (203). The minimal firing column logic (203) includes an exclusive and minimal amount of circuitry to maintain control of the high voltage circuits (207) until $V_{PP}$ (209) or $V_{PP}$_logic (210) drops below a threshold. In one example, the exclusive and minimal amount of circuitry to maintain control of the high voltage circuits (207) includes circuitry similar to the digital and analog control circuits (205).

The power loss protection circuit (112) of FIG. 2 may further include the digital control input (206). The digital control input (206) receives the data signals (219) from the printing device (FIGS. 1A and 1B, 100) to allow the power loss protection circuit (112) to process the data signals (219) into fire control signals as described above. Data signals (219) in the form of nozzle firing instructions based on a print job sent to the printing device (FIGS. 1A and 1B, 100) are received by the digital control input (206) and used by the low voltage circuits and high voltage circuits (207) to fire a number of nozzles within the printheads (FIGS. 1A and 1B, 110) of the printing device (FIGS. 1A and 1B, 100).

In one example, the $V_{DD}$_plp voltage regulation block (FIGS. 2 through 6, 212) may continuously provide $V_{DD}$_plp to a number of low voltage circuits that control the firing of a number of high voltage circuits before, during, and after a power loss event occurs as described above. In another example, the $V_{DD}$_plp voltage regulation block (FIGS. 2 through 6, 212) may provide $V_{DD}$_plp to the low voltage circuits when an uncontrolled power loss event occurs, but remaining inactive until the uncontrolled power loss event occurs as described above.

In one example, a start-up circuit may be included within the power loss protection circuit (112) upstream from the $V_{DD}$_plp voltage regulator (202). Many circuits have more than one stable operating mode. To ensure the whole of the power loss protection circuit (112) functions correctly, one or more of its inputs may be initialized. Examples of circuits that may utilize a start-up circuit may include flip-flops, oscillators, and current references. By forcing a voltage on a node, or a current into a branch, the start-up circuit brings the $V_{DD}$_plp voltage regulator (202) in a proper initial state after which normal operation may begin.

In one example, $V_{DD}$_plp (214, 314, 414, 514) is provided to all circuits used in controlling the high voltage circuits (207). In this example, the power loss protection circuit (112) provides a power loss protection to all non-high voltage circuits. Although providing $V_{DD}$_plp (214, 314, 414, 514) to all circuits used in controlling the high voltage circuits (207) ensures that the power loss protection circuit (112) continues to function as if no uncontrolled power loss event occurred, doing so may add to the cost of manufacturing the power loss protection circuit (112).

In another example, $V_{DD}$_plp (214, 314, 414, 514) is provided to an exclusive number of circuits used in controlling the high voltage circuits (207). In this example, the only circuits chosen to be powered by $V_{DD}$_plp (214, 314, 414, 514) are those circuits that draw little current, and are sufficient to ensure safe power down. This example excludes analog circuits which draw DC current including, for example, nozzle data memory upstream of the digital and analog control circuits (205) and minimal firing column logic (203). This also excludes high-frequency digital switching circuits such as those found in low voltage circuits within the power loss protection circuit (112).

Several different examples of architectures for the power loss protection circuit (112) will now be described in connection with FIGS. 3 through 6. Similar elements and their descriptions presented above in connection with FIG. 2 apply equally to the examples of FIGS. 3 through 6.

Figure 3:
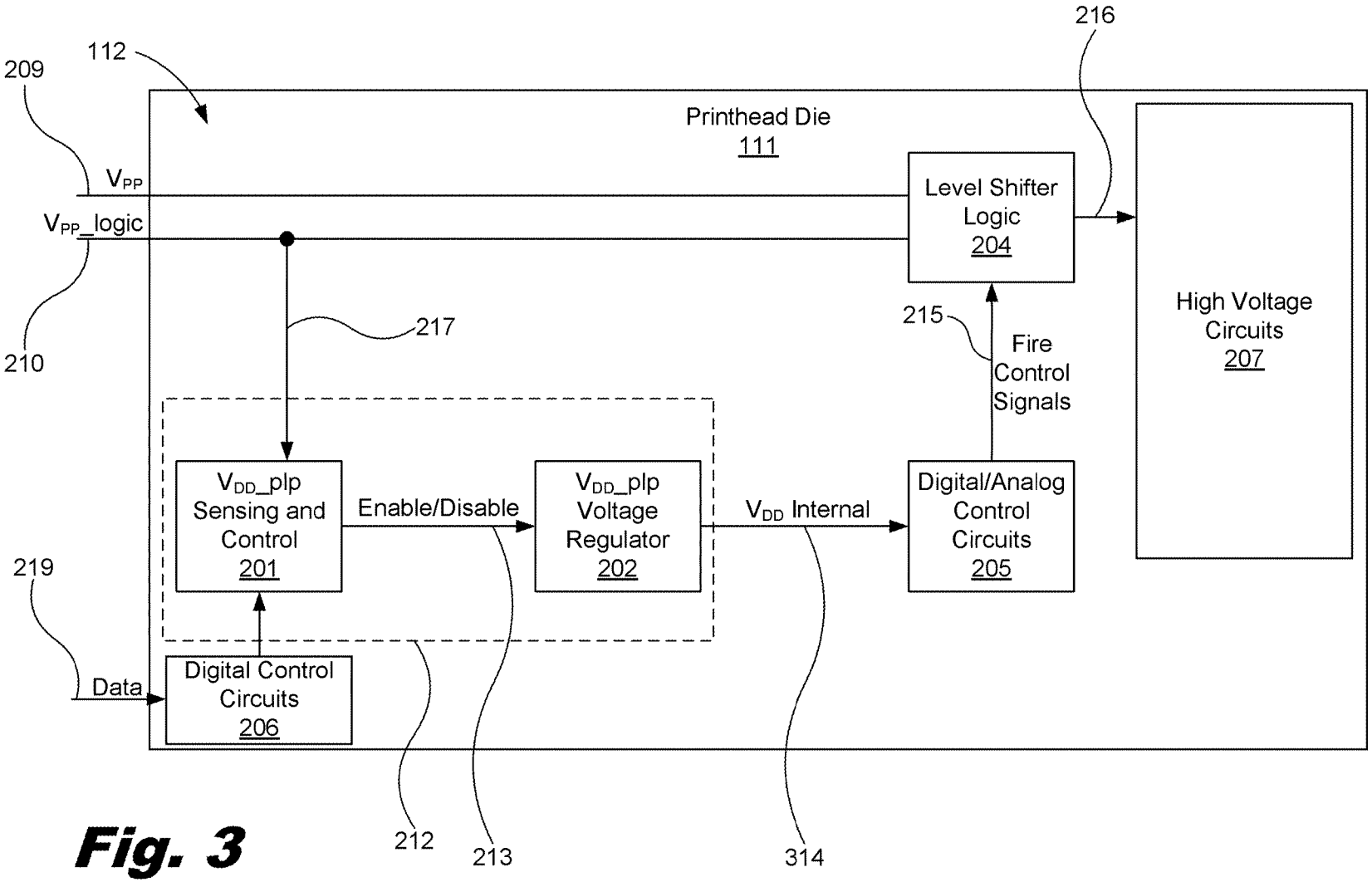
FIG. 3 is a diagram of a power loss protection circuit of the printing device of FIGS. 1A and 1B including an on-die $V_{DD}$_plp voltage regulation block and a $V_{DD}$_plp generated on-die to power all firing circuits during a power loss event, according to one example of the principles described herein.

FIG. 3 is a diagram of a power loss protection circuit (112) of the printing device (100) of FIG. 1 including an on-die $V_{DD}$_plp voltage regulation block (212) and a $V_{DD}$_plp generated on-die to power all firing circuits during a power loss event, according to one example of the principles described herein. The example of FIG. 3 provides for a situation where the $V_{DD}$_plp voltage regulation block (FIGS.

2 through 6, 212) continually provides $V_{DD}$_plp in the form of "$V_{DD}$ internal" (314) to the low voltage circuits. When an uncontrolled power loss event occurs, the $V_{DD}$_plp voltage regulation block (212) maintains, without first generating, $V_{DD}$_plp to the low voltage circuits until a high voltage power supply ($V_{PP}$) applied to the high voltage circuits or its associated logic line ($V_{PP}$_logic) drops below a threshold.

In the example of FIG. 3, the $V_{DD}$_plp sensing and control circuit (201) continually derives a supply voltage from $V_{PP}$_logic (210), and continually enables and provides $V_{PP}$_logic (210) to the $V_{DD}$_plp voltage regulator (202). The $V_{DD}$_plp voltage regulator (202) provides $V_{DD}$ internal (314) to the digital and analog control circuits (205) for the production of the fire control signals (215). The example of FIG. 3 may be classified as a high-side switch design, but may also be applied in a low-side switch circuit design.

In the example of FIG. 3, the power loss protection circuit (112) functions the same before, during, and after a power loss event occurs. This dedicated $V_{DD}$ internal (314) supply voltage has the advantage of requiring less circuitry on the printhead die (111). This reduces interconnect costs within the power loss protection circuit (112), and eliminates reliability risks associated with the interconnects that would otherwise be required. However, in the example of FIG. 3, the cost may be high due to complexity of the printhead die (111) and additional elements and devices on the printhead die (111).

Figure 4:
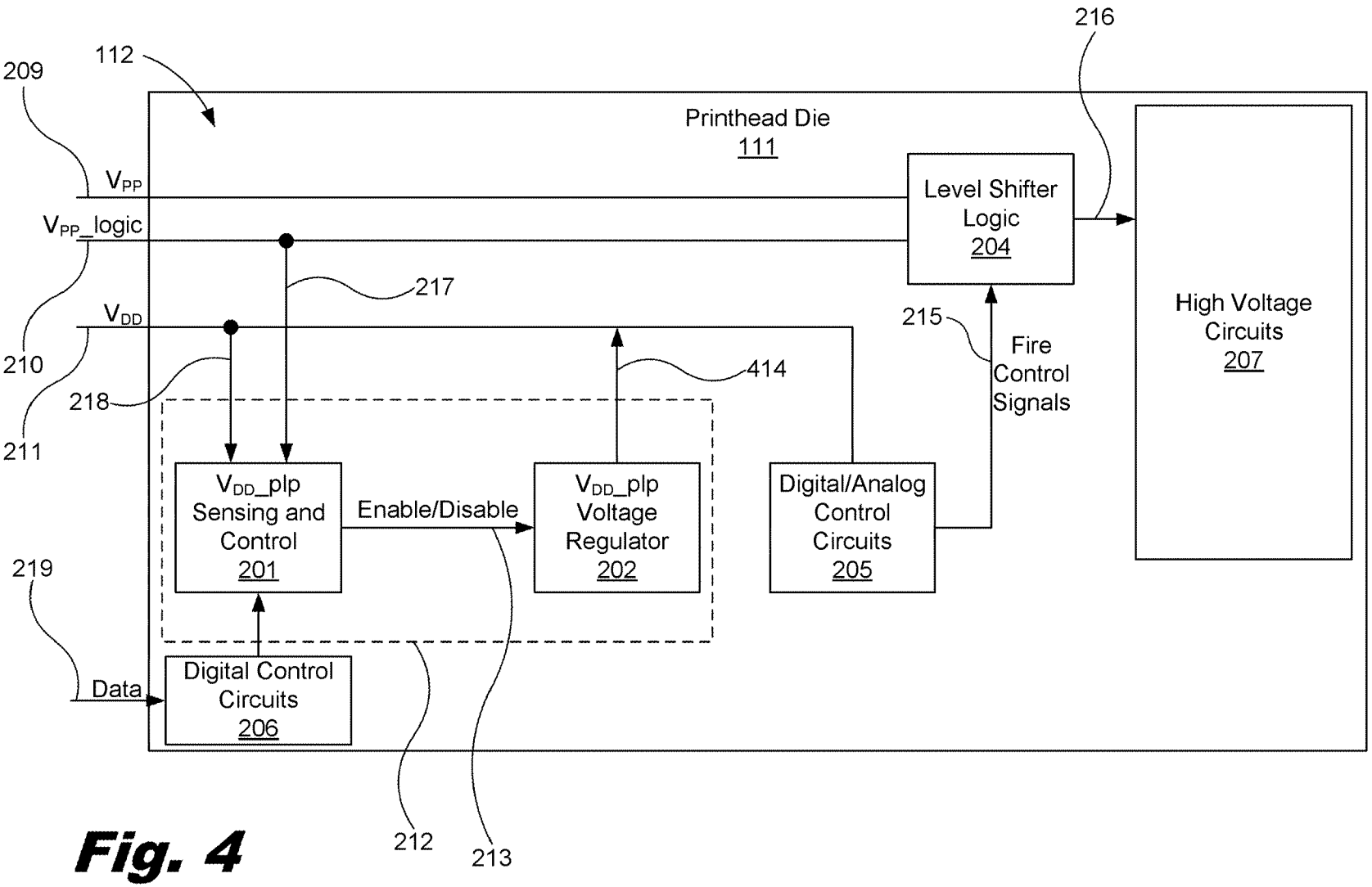
FIG. 4 is a diagram of the power loss protection circuit of the printing device of FIGS. 1A and 1B including an on-die $V_{DD}$_plp voltage regulator block to power a number of firing circuits if a power loss event occurs, according to one example of the principles described herein.

FIG. 4 is a diagram of the power loss protection circuit (112) of the printing device (100) of FIG. 1 including an on-die $V_{DD}$_plp voltage regulator block (212) to power a number of firing circuits if a power loss event occurs, according to one example of the principles described herein. The example of FIG. 4 provides for a situation where the $V_{DD}$_plp voltage regulation block (FIGS. 2 through 6, 212) may function to continually provide $V_{DD}$_plp low voltage circuits (205) or may provide $V_{DD}$_plp to the low voltage circuits when an uncontrolled power loss event occurs, but remain inactive until the uncontrolled power loss event occurs.

As depicted in FIG. 4, the power loss protection circuit (112) may derive $V_{DD}$_plp (414) from $V_{PP}$_logic (210) through line 217 and provide $V_{DD}$_plp (414) through the $V_{DD}$_plp voltage regulator (202) and line 414 to the digital and analog control circuits (205). Because the $V_{DD}$_plp sensing and control circuit (201) compares $V_{DD}$ (211) and $V_{PP}$_logic (210) to each other and the first and second threshold described above, the example of FIG. 4 may become active when a power loss event occurs and is detected by the $V_{DD}$_plp sensing and control circuit (201). However, the example of FIG. 4 may be utilized as a continuous $V_{DD}$_plp (414) generator. The example of FIG. 4 may be classified as a high-side switch design.

One difference between the example of FIG. 2 and the example of FIG. 4 is that the example of FIG. 4 provides $V_{DD}$_plp (414) directly to the digital and analog control circuits (205) rather than to the minimal firing column logic (203). This may simplify the power loss protection circuit (112) resulting in a reduction of cost in manufacturing.

Figure 5:
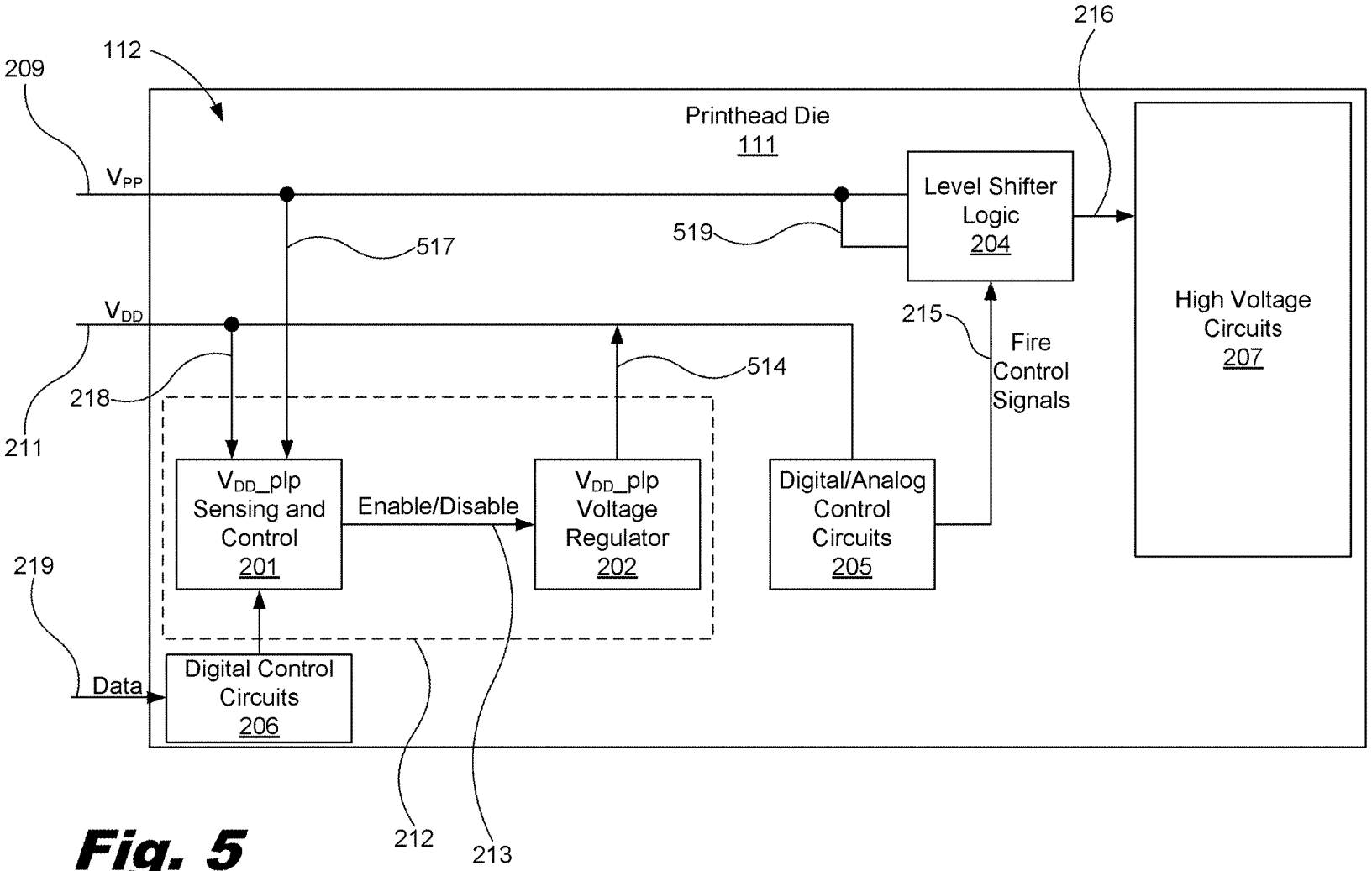
FIG. 5 is a diagram of the power loss protection circuit of the printing device of FIGS. 1A and 1B including an on-die $V_{DD}$_plp voltage regulator block to power a number of firing circuits and a combined $V_{PP}$ and $V_{PP}$_logic line, according to one example of the principles described herein.

FIG. 5 is a diagram of the power loss protection circuit (112) of the printing device (100) of FIG. 1 including an on-die $V_{DD}$_plp voltage regulator block (212) to power a number of firing circuits and a combined $V_{PP}$ and $V_{PP}$_logic line (209), according to one example of the principles described herein. The example of FIG. 5 is similar to the example of FIG. 4, but that the example of FIG. 5 does not include a dedicated $V_{PP}$_logic line (209). In this example, the $V_{DD}$_plp sensing and control circuit (201) derives $V_{DD}$_plp (514) from $V_{PP}$ (209) through line 517.

Further, the example of FIG. 5 includes a level shifter logic $V_{PP}$_logic line (519) that derives $V_{PP}$_logic line (210) from $V_{PP}$ (209). Thus, $V_{PP}$ (209) may be described as a combined $V_{PP}$ (209) and $V_{PP}$_logic (210) line.

Figure 6:
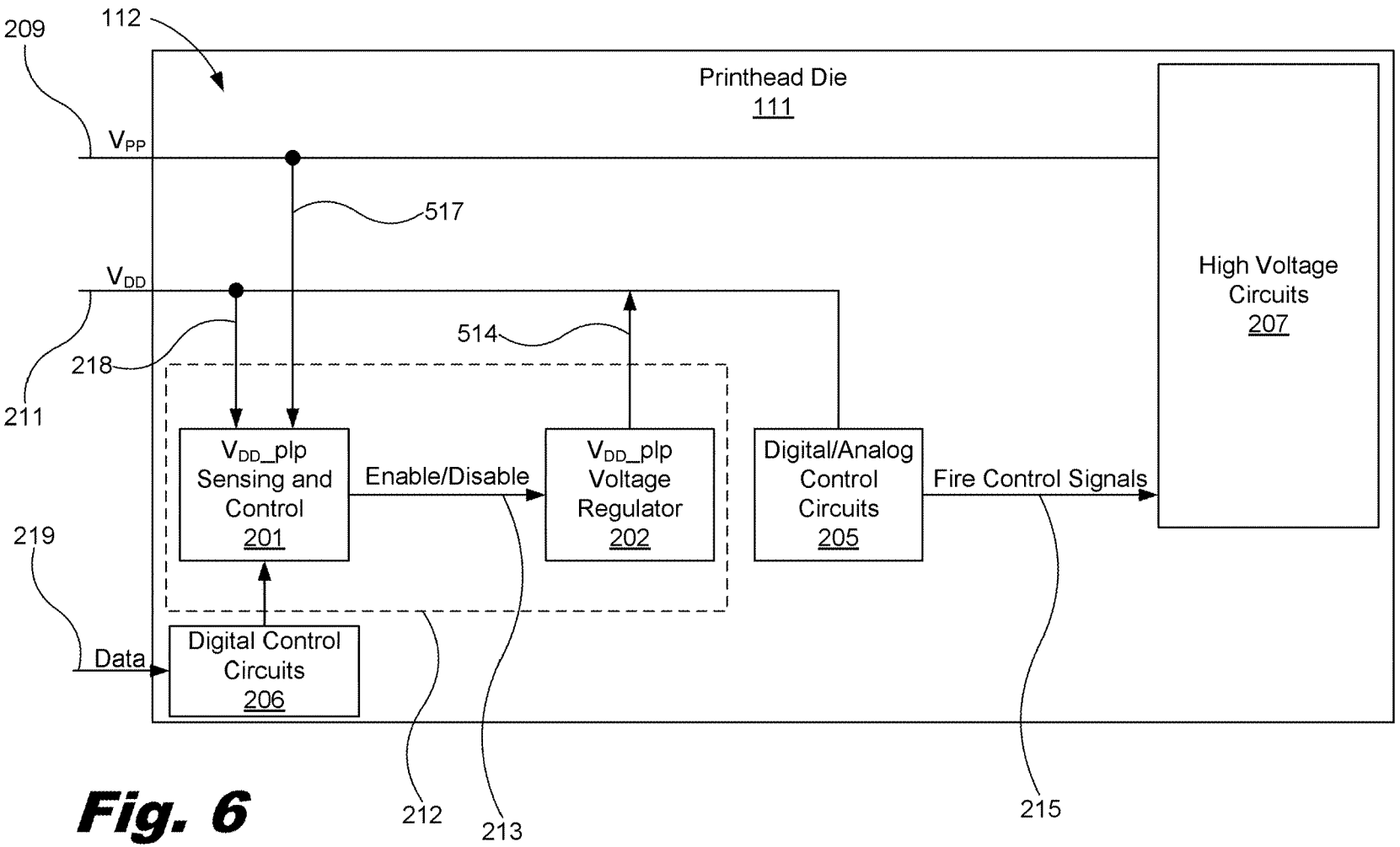
FIG. 6 is a diagram of the power loss protection circuit of the printing device of FIGS. 1A and 1B including an on-die $V_{DD}$_plp voltage regulator block to power a number of firing circuits and a combined $V_{PP}$ and $V_{PP}$_logic line, according to another example of the principles described herein.

FIG. 6 is a diagram of the power loss protection circuit (112) of the printing device (100) of FIG. 1 including an on-die $V_{DD}$_plp voltage regulator block (212) to power a number of firing circuits and a combined $V_{PP}$ and $V_{PP}$_logic line, according to another example of the principles described herein. The example of FIG. 6 may be classified as a low-side switch design because the switches within the high voltage circuits (207) are connected to a low supply rail such as, for example, ground.

In the example of FIG. 6, the fire control signals (215) are sent directly from the digital and analog control circuits (205) to the high voltage circuits (207) rather than involving level shifter logic (204). Further, the example of FIG. 6 includes a $V_{PP}$ (209) line that is a combined $V_{PP}$ (209) and $V_{PP}$_logic (210) line.

Throughout the examples of FIGS. 2 through 6, $V_{DD}$_plp (214, 314, 414, 514) is generated on the printhead die (111). One advantage of generating $V_{DD}$_plp (214, 314, 414, 514) on the printhead die (111) is that the $V_{DD}$_plp voltage regulator block (212) may be physically smaller. Area available on the printhead die (111) of a printhead (110) may be a significant driver of the manufacturing costs of the printhead.

Further, some of the examples of FIGS. 2 through 6 may exclude a number of circuits from receiving $V_{DD}$_plp (214, 314, 414, 514). An advantage of excluding a number of circuits from receiving $V_{DD}$_plp (214, 314, 414, 514) is that if $V_{DD}$_plp (214, 314, 414, 514) is generated and maintained off-die, it may be more cost-effective to also implement the exclusive circuits which maintain voltage on $V_{DD}$_plp (214, 314, 414, 514) off the printhead die (111) if there is a small load on $V_{DD}$_plp (214, 314, 414, 514).

Further, some of the examples of FIGS. 2 through 6 where $V_{DD}$_plp voltage regulator block (212) does not continuously provide $V_{DD}$_plp (214, 314, 414, 514) to a number of low voltage circuits, but, instead, is active when an uncontrolled power loss event occurs, the $V_{DD}$_plp voltage regulator (202) receives the instruction from the $V_{DD}$_plp sensing and control circuit (201), and begins to provide $V_{DD}$_plp to a number of low voltage circuits as described herein. In this example, the $V_{DD}$_plp voltage regulator block (212) remains inactive until an uncontrolled power loss event occurs. In an example where the $V_{DD}$_plp voltage regulator block (212) continuously provides $V_{DD}$_plp (214, 314, 414, 514) to a number of low voltage circuits irrespective of whether an uncontrolled power loss event has occurred, the $V_{DD}$_plp sensing and control circuit (201) may be optional within the power loss protection circuit (112).

Figure 8:
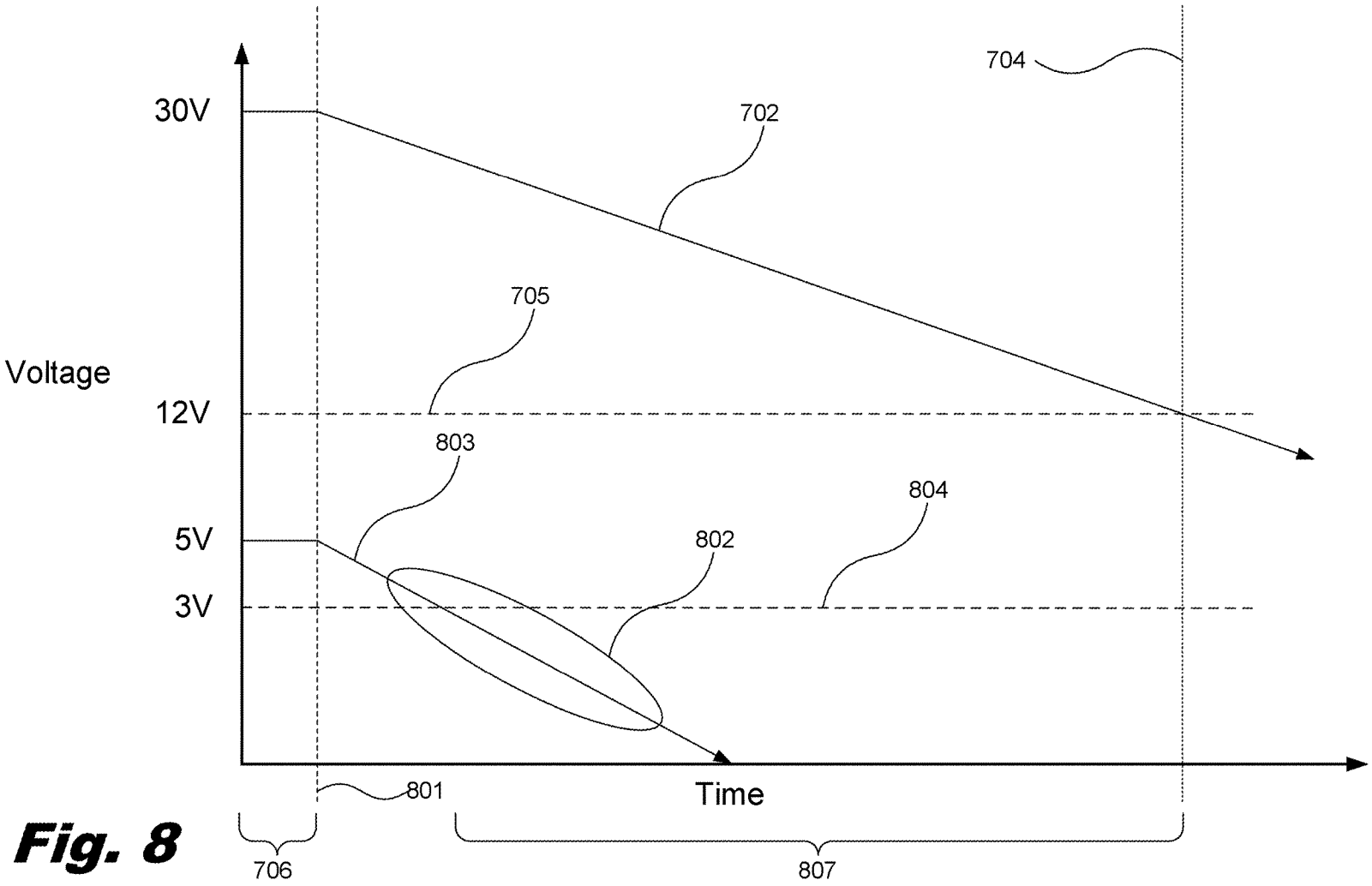
FIG. 8 is a graph depicting an uncontrolled power down sequence of a printing device without the power loss protection circuits of FIGS. 2 through 6, according to one example of the principles described herein.
Figure 9:
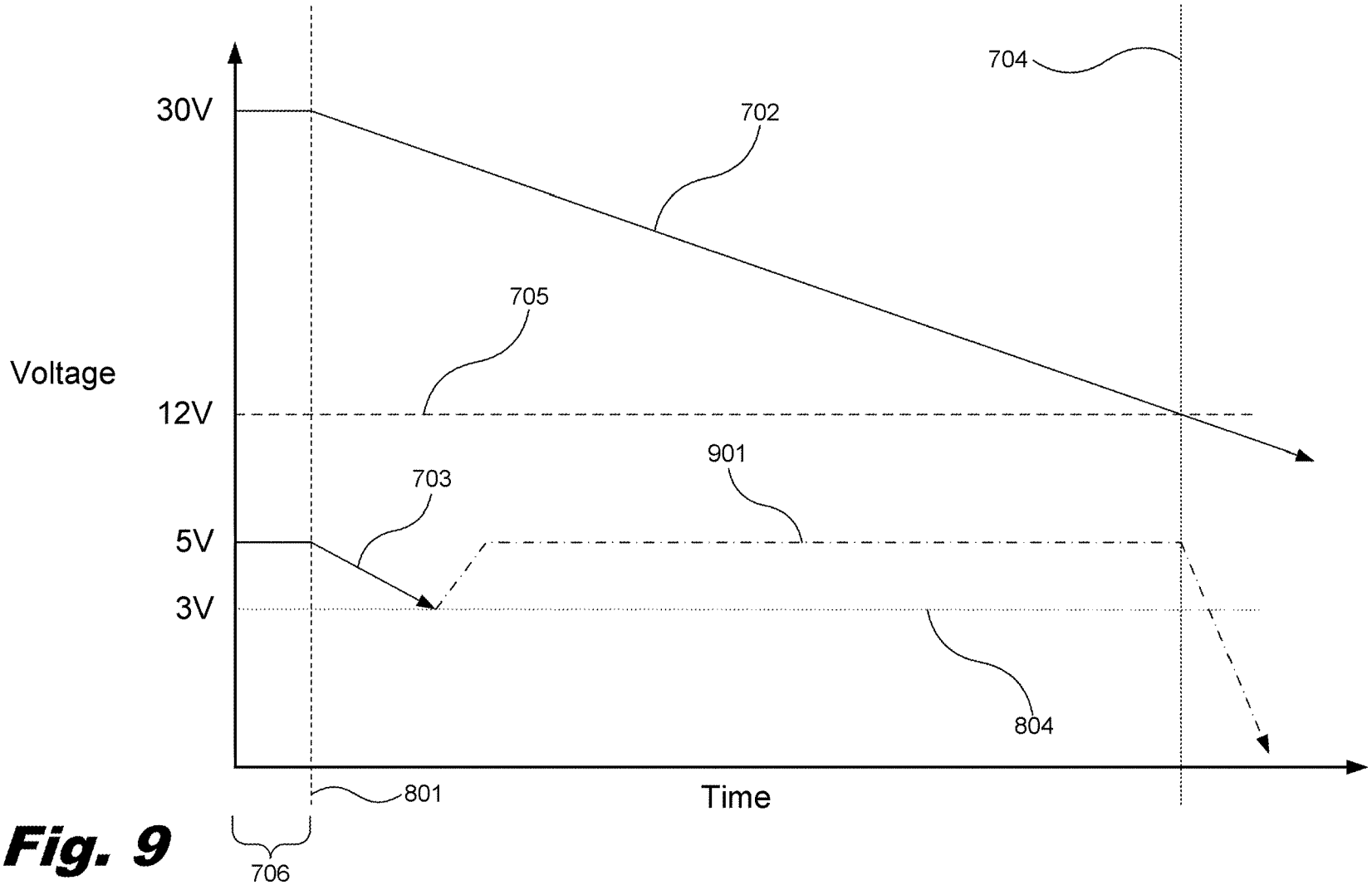
FIG. 9 is a graph depicting an uncontrolled power down sequence of a printing device with one of the power loss protection circuits of FIGS. 2 through 6, according to one example of the principles described herein.

The possibilities associated with controlled or uncontrolled loss of power to the printing device (FIGS. 1A and 1B, 100) and its power loss protection circuit (112) will now be described in connection with FIGS. 7 through 9. The numbers, values, units, curves, lines, or other aspects of FIGS. 7 through 9 are only examples to be used in describing the processes associated with controlled or uncontrolled loss of power.

Figure 7:
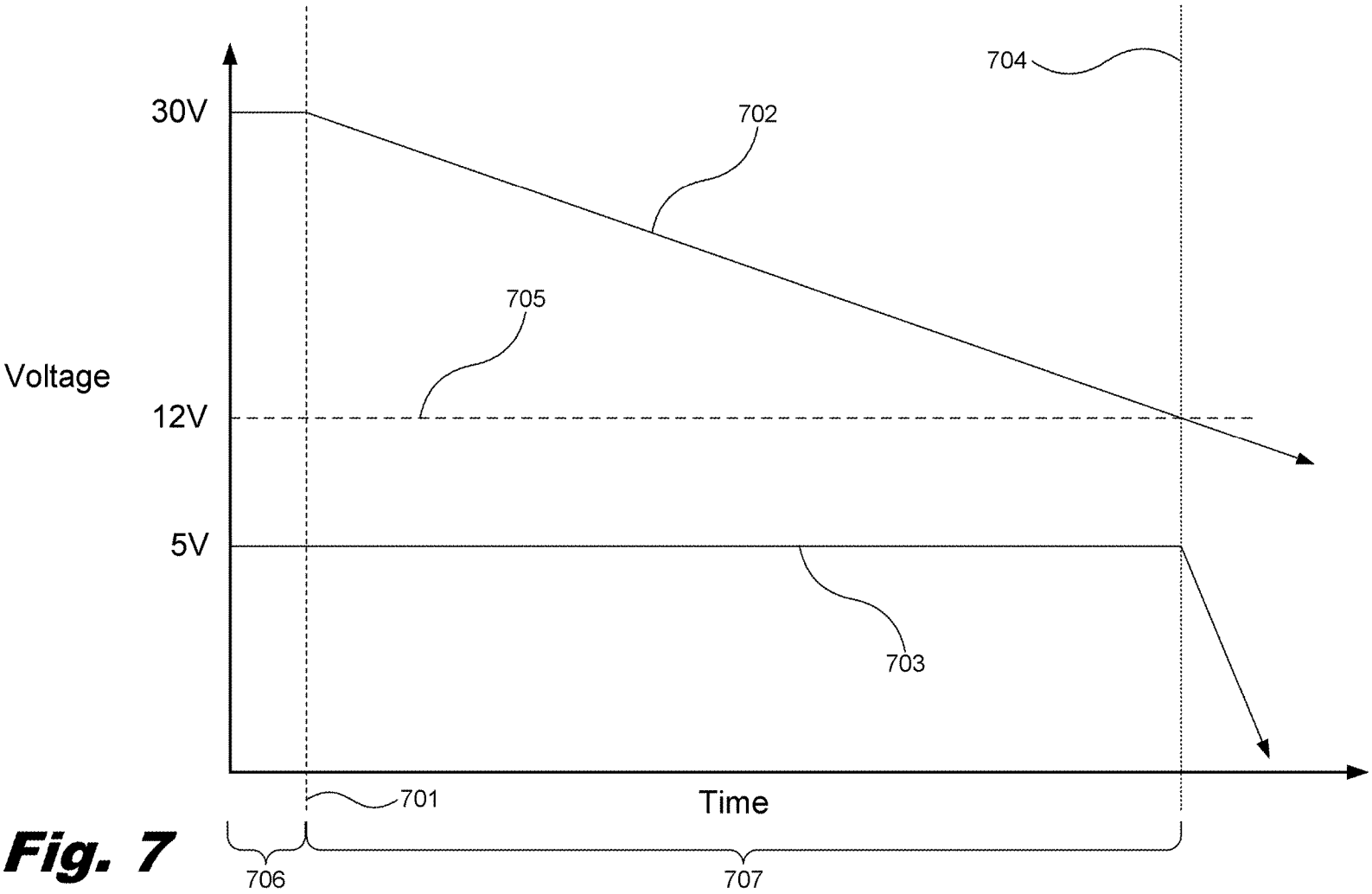
FIG. 7 is a graph depicting a printer controlled power down sequence, according to one example of the principles described herein.

FIG. 7 is a graph depicting a printer controlled power down sequence, according to one example of the principles described herein. Printing devices (FIGS. 1A and 1B, 100) are designed to power down the printheads (FIGS. 1A and 1B, 110) and their respective high voltage circuits (207) in a controlled and safe manor. This controlled power down uses a protocol to power down circuits within the printing device (FIGS. 1A and 1B, 100) including $V_{DD}$_plp voltage regulator block (212) including a $V_{DD}$_plp sensing and control circuit (201) and a $V_{DD}$_plp voltage regulator (202), the minimal firing column logic (203), level shifter logic (204), the digital and analog control circuits (205), digital control circuits (206), and high voltage circuits (207), in a sequence that will not damage the circuits. A controlled power down may occur when a request is made to do so, such as when a user pushes a power button on the printing device (FIGS. 1A and 1B, 100). This sequence may include powering down the multiple power supplies used on a printhead such as $V_{PP}$ (FIGS. 2 through 6, 209), $V_{PP}$_logic (FIGS. 2 through 4, 210), and $V_{DD}$ (FIGS. 2 and 3, 211, 221) in a particular sequence.

In the examples described in connection with FIGS. 2 and 6, the $V_{DD}$_plp voltage regulator block's (212) derivation of power from the high voltage power supply ($V_{PP}$) (209) or high voltage logic power supply ($V_{PP}$_logic) (210) ensures that the voltages provided to the $V_{DD}$_plp sensing and control circuit (201), the $V_{DD}$_plp voltage regulator (202), the minimal firing column logic (203), the level shifter logic (204), the digital and analog control circuits (205), and the digital control circuits (206) drop to a safe voltage level after $V_{PP}$ drops to a safe level. Further, the manner in which the power loss protection circuit (112) powers down the low voltage circuits (201, 202, 203, 204, 205, and 206) and high voltage circuits (207) is independent of the architecture of the power supplies within the power loss protection circuit (112), and independent of firmware sequencing controls provided by, for example, the processor (FIG. 1A, 101) of the printing device (FIGS. 1A and 1B, 100).

As depicted in FIG. 7, the y-axis represents voltage levels within the power loss protection circuit (112) of the printing device (FIGS. 1A and 1B, 100). The x-axis represents time. In one example, the time taken to power down the printing device (FIGS. 1A and 1B, 100) and its various circuitry may be on the order of microseconds or milliseconds. However, because the present systems and methods ensure that the $V_{DD}$_plp voltage regulator block (212) provides $V_{DD}$_plp (214) until a sufficient bleed down of $V_{PP}$ (209, 219) as described herein, the x-axis and its indication of time is independent of any required or specified time period.

Initially, the printing device (FIGS. 1A and 1B, 100) is operating at normal voltages as indicated by bracket 706. During this period before the controlled power down sequence begins, $V_{PP}$ (209) may be at, for example, approximately 30 volts, and $V_{DD}$ (211) may be at, for example, 5 volts. These are example voltages, and $V_{PP}$ (209) and $V_{DD}$ (211) may operate at other voltages or voltage ranges depending on voltage requirements of the circuits within the printing device (FIGS. 1A and 1B, 100). In FIGS. 7 through 9, line 702 indicates the voltage level of $V_{PP}$ (209) before and during the controlled power down, and line 703 indicates the voltage level of $V_{DD}$ (211) before and during the controlled power down.

Line 701 indicates the instance when the printing device (FIGS. 1A and 1B, 100) initiates a controlled power down sequence. When the controlled power down sequence begins at 701, $V_{PP}$ (702) begins to bleed down. As the controlled power down sequence occurs, a number of circuit elements such as a number of capacitors within the high voltage circuits (207) start dissipating their stored energy. During the controlled power down, the printing device (100) maintains the voltage level of $V_{DD}$ (703) until $V_{PP}$ (702) drops below a threshold voltage (705). This allows the high voltage circuits (207) to safely bleed down in a controlled manner without damaging circuitry within the high voltage circuits (207).

In one example, the threshold voltage (705) is approximately 12 volts. In this example, the threshold voltage (705) is 12 volts because this is a minimum voltage level at which a number of circuits used to switch $V_{PP}$_logic (210) into a firing event of the nozzles within the printheads (FIGS. 1A and 1B, 110) are operable. However, the threshold voltage (705) required for operation of the circuits used to switch $V_{PP}$_logic (210) may be any voltage level. Once the voltages provided by $V_{PP}$_logic (210) and stored within the high voltage circuits (207) bleeds below the threshold voltage (705), the possibility of damage to the high voltage circuits (207) is mitigated or eliminated.

$V_{DD}$ (703) is maintained at a voltage level sufficient to power a number of circuits used to control the high voltage circuits (207) including the $V_{DD}$_plp sensing and control circuit (201), the $V_{DD}$_plp voltage regulator (202), the minimal firing column logic (203), the level shifter logic (204), the digital and analog control circuits (205), and the digital control circuits (206), or combinations thereof. In one example, the voltage level maintained by $V_{DD}$ (703) is 5 volts. However, the voltage level required for operation of the circuits used to control the high voltage circuits (207) may be any voltage level.

The period at which the printing device (100) maintains the voltage level of $V_{DD}$ (703) during a controlled power down sequence is indicated by bracket 406. The period (707) of maintaining $V_{DD}$ (703) at its operating voltage level may end at line 704 where $V_{PP}$ (702) drops below the threshold voltage (705). At 704, $V_{DD}$ (703) may also bleed down as $V_{PP}$ (702) continues to bleed down.

FIG. 8 is a graph depicting an uncontrolled power down sequence of a printing device (FIGS. 1A and 1B, 100) without the power loss protection circuits (112) of FIGS. 2 through 6, according to one example of the principles described herein. As described above in connection with FIG. 7, the printing device (FIGS. 1A and 1B, 100) initially operates at normal voltages as indicated by bracket 706. An uncontrolled power loss event may occur at line 801 with line 803 indicating the voltage level of $V_{DD}$ (211) before and during an uncontrolled power down. In the uncontrolled power down sequence of FIG. 8, $V_{DD}$ (803) immediately starts to bleed down.

Line 804 indicates a minimal voltage level at which the low voltage circuits (201, 202, 203, 204, 205, and 206) may be able to continue to control the high-voltage circuits (207). When the low voltage circuits (201, 202, 203, 204, 205, and 206) bleed down past this low voltage threshold (804), the low voltage circuits (201, 202, 203, 204, 205, and 206) may be in an unknown state that may result in detrimental high voltage firing within the high-voltage circuits (207).

As depicted in FIG. 8, $V_{DD}$ (803) bleeds down at a faster rate than $V_{PP}$ (702) bleeds down due, in part, to large capacitance within the high voltage circuits (207). Within the area designated by 802, even though the printhead die (FIGS. 2 through 6, 111) may have been reset via the application of a number of reset signals, the low voltage circuits (201, 202, 203, 204, 205, and 206) may be in an unknown state due to a relatively low $V_{DD}$ (803). This may result in the high voltage circuits (207) firing uncontrollably, and may result in damage to or destruction of the resistors and other active devices within the high voltage circuits (207). In order to overcome this potential for damage, the power loss protection circuit (112) maintains $V_{DD}$ (803) at an active voltage level until after $V_{PP}$ (702) falls below the threshold voltage (705) as will now be described in connection with FIG. 9.

FIG. 9 is a graph depicting an uncontrolled power down sequence of a printing device (FIGS. 1A and 1B, 100) with the power loss protection circuits (112) of FIGS. 2 through 6, according to one example of the principles described herein. As described in connection with FIG. 8, line 803 indicates the voltage level of $V_{DD}$ (211) before and during an uncontrolled power down. In order to maintain $V_{DD}$ (803) at an active voltage level until after $V_{PP}$ (702) falls below the threshold voltage (705), the $V_{DD}$_plp voltage regulation block (FIGS. 2 through 6, 212) provides $V_{DD}$_plp (FIGS. 2 through 6, 214, 314, 414, 514) as indicated by line 901. In this manner, a number of the non-high voltage circuits are maintained at an active voltage level until after $V_{PP}$ (702) falls below the threshold voltage (705) by using the $V_{DD}$_plp voltage regulation block (FIGS. 2 through 6, 212) to maintain $V_{DD}$_plp (FIGS. 2 through 6, 214, 314, 414, 514) in place of the original $V_{DD}$ (211). Non-high voltage circuits include the $V_{DD}$_plp voltage regulator block (212) including a $V_{DD}$_plp sensing and control circuit (201) and a $V_{DD}$_plp voltage regulator (202), the minimal firing column logic (203), the level shifter logic (204), the digital and analog control circuits (205), the digital control circuits (206), and combinations thereof. Thus, as described in connection with FIG. 9, the $V_{DD}$_plp voltage regulation block (FIG. 2 through 6, 212) reduces or eliminates the potential for uncontrolled high voltage dissipation within printhead resistive elements and other active devices in a number of high voltage circuits (FIGS. 2 through 6, 207) of the printing device (FIGS. 1A and 1B, 100) that may render the resistors and other active devices inoperable.

Figure 10:
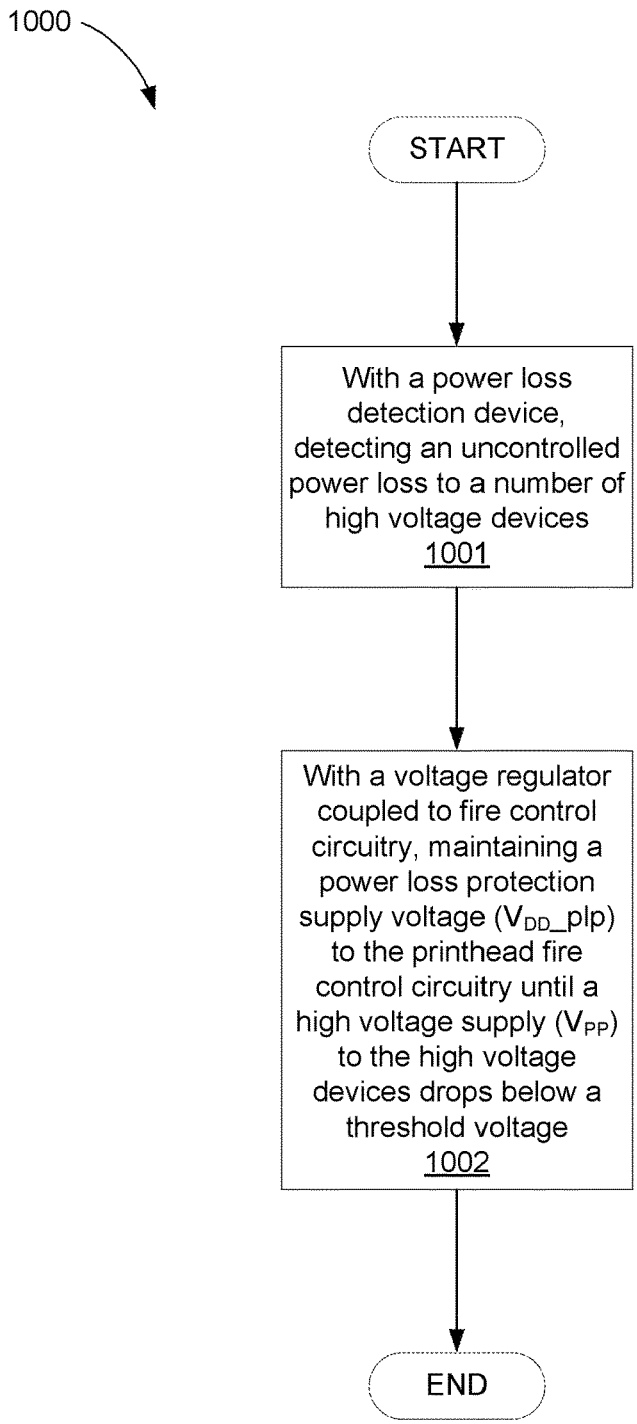
FIG. 10 is a flowchart showing a method of operating a printing device during a power loss event, according to one example of the principles described herein.

FIG. 10 is a flowchart showing a method (1000) of operating a printing device (FIGS. 1A and 1B, 100) during a power loss event, according to one example of the principles described herein. The method (1000) of FIG. 10 may begin by detecting (block 1001) an uncontrolled power loss to a number of high voltage devices (FIGS. 2 through 6, 207). Detection (block (1001) of the power loss may be performed by a power loss detection device such as the $V_{DD}$_plp sensing and control circuit (FIGS. 2 through 6, 201).

The method (1000) may further include, with $V_{DD}$_plp voltage regulator (FIGS. 2 through 6, 202) coupled to printhead fire control circuitry (FIGS. 2 through 6, 203, 204, 205), maintaining a power loss protection supply voltage ($V_{DD}$_plp) to the printhead fire control circuitry until a high voltage supply ($V_{PP}$) to the high voltage devices (FIGS. 2 through 6, 207) drops below a threshold voltage (705). The fire control circuitry may include the minimal firing column logic (203), the level shifter logic (204), the digital and analog control circuits (205), and combinations thereof.

In this manner, the high voltage devices (FIGS. 2 through 6, 207) are protected from damage to or destruction of the resistors and other active devices within the high voltage devices (FIGS. 2 through 6, 207). This type of damage may occur if the high voltage devices (FIGS. 2 through 6, 207) were allowed to fire without being controlled by the low voltage circuits (FIGS. 2 through 6, (201, 202, 203, 204, 205, and 206) and other circuitry used to control the firing of the high voltage devices (FIGS. 2 through 6, 207).

Figure 11:
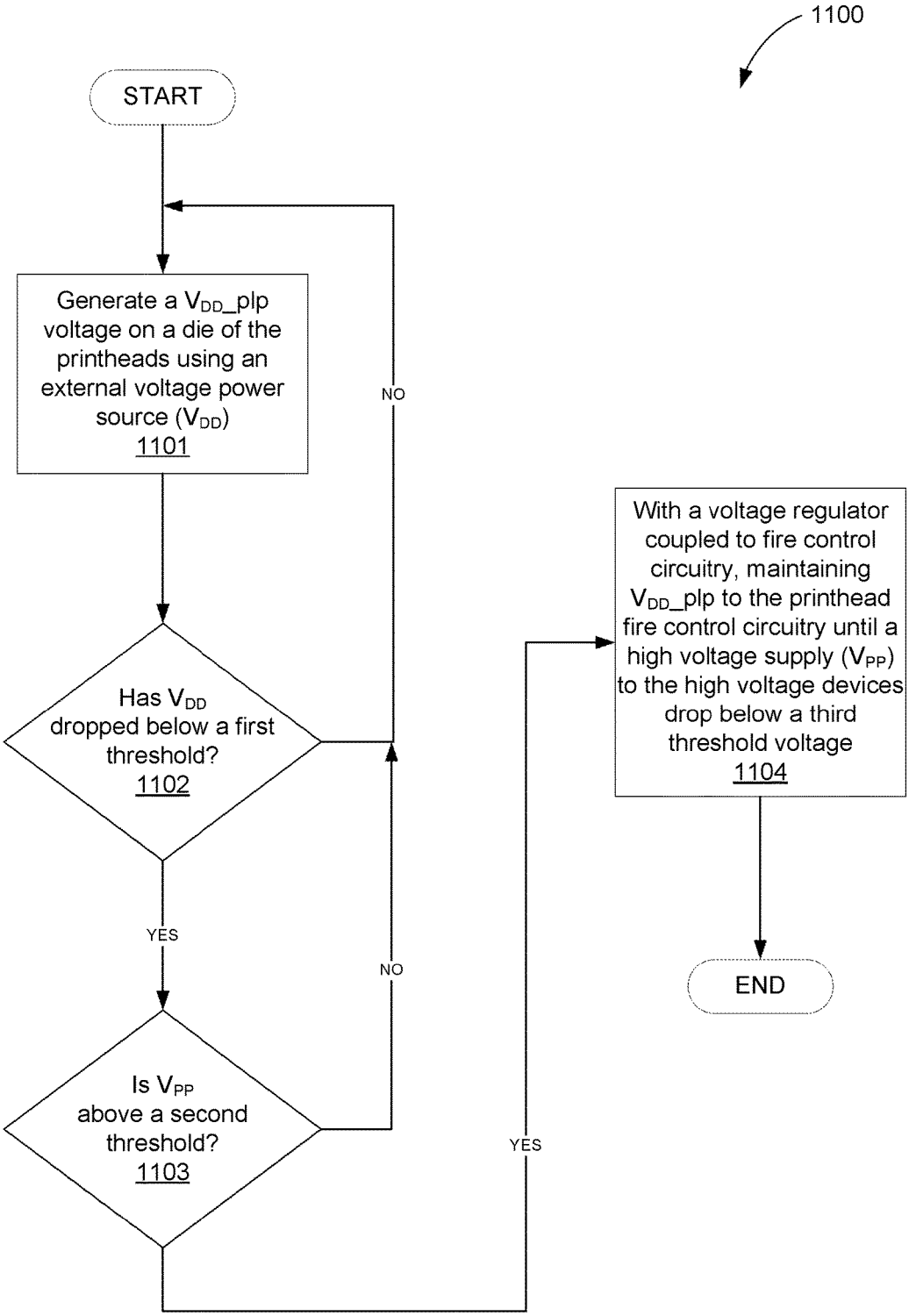
FIG. 11 is a flowchart showing a method of operating a printing device during a power loss event, according to another example of the principles described herein.

FIG. 11 is a flowchart showing a method of operating a printing device (FIGS. 1A and 1B, 100) during a power loss event, according to another example of the principles described herein. The method of FIG. 11 may begin by generating (block 1101) a $V_{DD}$_plp voltage on a die of the printheads using an external voltage power source ($V_{DD}$), In one example, the external power source may be obtained from a low voltage power source such as directly from $V_{DD}$ as described above in connection with FIGS. 2, 4, 5, and 6. In another example, he external power source may be obtained directly or indirectly from a high voltage power source such as $V_{PP}$ or $V_{PP}$_logic as described above in connection with FIG. 3.

The method (1100) may continue with determining (block 1102) if the external $V_{DD}$ has dropped below a first threshold. This may be performed using the $V_{DD}$_plp sensing and control circuit (FIGS. 2 through 6, 201). In one example, the first threshold is any threshold voltage at which the low voltage circuits (201, 202, 203, 204, 205, and 206) may be able to continue to control the high-voltage circuits (207). In one example, the first threshold may be approximately 3 volts as depicted in FIGS. 8 and 9. If $V_{DD}$ has not dropped below the first threshold (block 1102, determination NO), then the method (1100) may loop back to block 1101, and $V_{DD}$_plp may continue to be generated.

If $V_{DD}$ has dropped below the first threshold (block 1102, determination YES), then the $V_{DD}$_plp sensing and control circuit (FIGS. 2 through 6, 201) determines (block 1103) if $V_{PP}$ is above a second threshold. In one example, the second threshold is any threshold voltage at which the high voltage devices (FIGS. 2 through 6, 207) may continue to function.). In one example, the second threshold may be approximately 12 volts as depicted in FIGS. 7 through 9. If $V_{PP}$ is not above the second threshold (block 1103, determination NO), then there is no risk that the high voltage devices (FIGS. 2 through 6, 207) may continue to function uncontrollably and destroy or otherwise render inoperable restive elements or other circuits within the high voltage devices (FIGS. 2 through 6, 207). Thus, the method (1100) may loop back to block 1101, and $V_{DD}$_plp may continue to be generated.

If $V_{PP}$ is above the second threshold (block 1103, determination YES), then there exists a risk that the high voltage devices (FIGS. 2 through 6, 207) may continue to function uncontrollably and destroy or otherwise render inoperable restive elements or other circuits within the high voltage devices (FIGS. 2 through 6, 207). Therefore, the method (1100) may, with the $V_{DD}$_plp voltage regulator (FIGS. 2 through 6, 202), generate (block 1104) the VDD_plp using the $V_{PP}$ or the $V_{PP}$ logic power source ($V_{PP}$_logic) associated with the $V_{PP}$.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor (101) of the printing device (100) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe systems and methods for operating a printing device during a power loss event. The method may include with a power loss detection device, detecting an uncontrolled power loss to a number of high voltage devices. The method further includes, with a voltage regulator coupled to printhead fire control circuitry, maintaining a power loss protection supply voltage ($V_{DD}$_plp) to the printhead fire control circuitry until a high voltage supply ($V_{PP}$) to the high voltage devices drops below a threshold voltage. A circuit topology for a printing device includes a high voltage power source ($V_{PP}$) connected to a number of high voltage devices used to fire a number of printheads. The circuit topology further includes a power loss detection device to detect a power loss to the printing device, and a voltage regulator to regulate an input voltage to produce a power loss protection supply voltage ($V_{DD}$_plp). $V_{DD}$_plp is provided to printhead fire control circuitry if the power loss detection device detects a power loss to the printing device. The printhead fire control circuitry controls current in the high voltage devices.

This operation of the printing device during a power loss event may have a number of advantages, including: (1) protecting resistors and other circuits within the high voltage circuits from damage resulting from power loss events; (2) reduces the cost of manufacturing the printing device by not requiring extra system-level components and by enabling possible cost reduction of existing power-down circuits; and (3) provides for fully integrated power loss protection circuitry on the printhead die using minimal die area, among other advantages.

The preceding description has been presented to illustrate and describe examples of the principles described. This description is not intended to be exhaustive or to limit these principles to any precise form disclosed. Many modifications and variations are possible in light of the above teaching.

What is claimed is:

1. A circuit topology for a printing device, comprising:

a high voltage power source ($V_{PP}$) connected to a number of high voltage devices used to fire a number of printheads;

a power loss detection device to detect a power loss to the printing device;

a voltage regulator to regulate an input voltage to produce a power loss protection supply voltage ($V_{DD}$_plp), $V_{DD}$_plp being provided to printhead fire control circuitry if the power loss detection device detects a power loss to the printing device, the printhead fire control circuitry to control current in the high voltage devices.

2. The circuit topology of claim 1, in which the $V_{DD}$_plp voltage is generated on a printhead die, $V_{DD}$_plp voltage being derived from $V_{PP}$.

3. The circuit topology of claim 1, in which $V_{DD}$_plp is generated on a printhead die, $V_{DD}$_plp voltage being derived from a $V_{PP}$ logic power source ($V_{PP}$ logic) associated with $V_{PP}$.

4. The circuit topology of claim 1, in which power loss is determined to have occurred if the power loss detection device detects a $V_{DD}$ power source used to power a number of low voltage circuits drops below a first threshold and $V_{PP}$ is above a second threshold.

5. The circuit topology of claim 1, in which controlling current in the high voltage device with the printhead fire control circuitry comprises powering all printhead fire control circuitry until $V_{PP}$ is below a discharge threshold.

6. The circuit topology of claim 1:

in which the $V_{DD}$_plp voltage is generated on the die of the printheads using an external voltage power source ($V_{DD}$), and in which power loss is determined to have occurred if the power loss detection device detects the external $V_{DD}$ drops below a first threshold and $V_{PP}$ is above a second threshold.

7. The circuit topology of claim 6, in which if the power loss detection device detects the external $V_{DD}$ drops below a first threshold and $V_{PP}$ is above a second threshold, then, with the voltage regulator, generating the $V_{DD}$_plp using the $V_{PP}$.

8. The circuit topology of claim 6, in which if the power loss detection device detects the external $V_{DD}$ drops below a first threshold and $V_{PP}$ is above a second threshold, then, with the voltage regulator, generating the $V_{DD}$_plp using the $V_{PP}$ logic.

9. The circuit topology of claim 1, in which the printhead fire control circuitry comprises only circuitry used to maintain control of the high voltage devices.

10. A printing device comprising:

a number of printheads, each printhead comprising:

a number of resistive ink firing elements; and a number of high voltage circuits to drive the resistive ink firing elements;

a high voltage power source ($V_{PP}$) to power the printheads;

a number of low voltage circuits to provide a number of fire control signals to the high voltage circuits;

a power loss protection supply voltage ($V_{DD}$_plp) produced by a voltage regulator to regulate an input voltage, the $V_{DD}$_plp being connected to the low voltage circuits to provide power to the low voltage circuits; and a power loss detection device to detect a power loss to the printing device.

11. The printing device of claim 10, in which the printing device generates the $V_{DD}$_plp voltage on a die of the printheads using an external voltage power source ($V_{DD}$), in which power loss is determined to have occurred if the power loss detection device detects the external $V_{DD}$ drops below a first threshold and $V_{PP}$ is above a second threshold, in which if power loss is detected, with the voltage regulator, generating the $V_{DD}$_plp using the $V_{PP}$ or a $V_{PP}$ logic power source ($V_{PP}$_logic) associated with the $V_{PP}$.

12. The printing device of claim 10, in which providing power to the low voltage circuits comprises powering all low voltage circuits until $V_{PP}$ is below a discharge threshold.

13. The printing device of claim 11, further comprising a startup circuit coupled to a front end of the voltage regulator to power the voltage regulator with the $V_{PP}$ or the $V_{PP}$_logic, in which if the startup circuit detects the $V_{PP}$ or the $V_{PP}$_logic, powering the voltage regulator such that a digital control signal is able to be received at the voltage regulator.

14. A method of operating a printing device during a power loss event comprising:

with a power loss detection device, detecting an uncontrolled power loss to a number of high voltage devices;

with a voltage regulator coupled to printhead fire control circuitry, maintaining a power loss protection supply voltage ($V_{DD}$_plp) to the printhead fire control circuitry until a high voltage supply ($V_{PP}$) to the high voltage devices drops below a threshold voltage.

15. The method of claim 14, further comprising:

generating the $V_{DD}$_plp voltage on a die of the printheads using an external voltage power source ($V_{DD}$), in which detecting an uncontrolled power loss to a number of high voltage devices comprises:

determining if the external $V_{DD}$ drops below a first threshold and $V_{PP}$ is above a second threshold, in which if power loss is detected, with the voltage regulator, generating the $V_{DD}$_plp using the $V_{PP}$ or a $V_{PP}$ logic power source ($V_{PP}$ logic) associated with the $V_{PP}$.

* * * * *